US009236655B2

(12) United States Patent
Silva

(10) Patent No.: US 9,236,655 B2
(45) Date of Patent: Jan. 12, 2016

(54) ANTENNA ASSEMBLY AND METHOD OF MAKING SAME

(71) Applicant: David Silva, Nuertingen (DE)

(72) Inventor: David Silva, Nuertingen (DE)

(73) Assignee: HIRSCHMANN CAR COMMUNICATION GMBH, Neckartenzlingen (DE)

( * ) Notice: Subject to any disclaimer, the term of this patent is extended or adjusted under 35 U.S.C. 154(b) by 283 days.

(21) Appl. No.: 13/758,217

(22) Filed: Feb. 4, 2013

(65) Prior Publication Data

US 2013/0214992 A1 Aug. 22, 2013

(30) Foreign Application Priority Data

Feb. 7, 2012 (DE) ..... 10 2012 002 182

(51) Int. Cl.

| | |
|---|---|
| ***H01Q 1/50*** | (2006.01) |
| ***H01Q 1/12*** | (2006.01) |
| ***H01Q 1/20*** | (2006.01) |
| ***H01Q 1/32*** | (2006.01) |
| ***H01Q 23/00*** | (2006.01) |
| ***H01Q 1/22*** | (2006.01) |
| ***H01R 12/79*** | (2011.01) |
| ***H01P 11/00*** | (2006.01) |

(52) U.S. Cl.

CPC ..... *H01Q 1/50* (2013.01); *H01Q 1/1271* (2013.01); *H01Q 1/20* (2013.01); *H01Q 1/22* (2013.01); *H01Q 1/325* (2013.01); *H01Q 23/00* (2013.01); *H01R 12/79* (2013.01); *H01R 2201/02* (2013.01); *Y10T 156/1052* (2015.01)

(58) Field of Classification Search

CPC ..... H01Q 1/1271; H01Q 1/32; H01Q 1/325; H01Q 1/3275; H01Q 1/3283; H01Q 1/50; H01R 2201/02

See application file for complete search history.

(56) References Cited

U.S. PATENT DOCUMENTS

2007/0052601 A1 * 3/2007 Onishi et al. ..... 343/713

FOREIGN PATENT DOCUMENTS

JP 2000-196327 * 7/2000 ..... H01Q 1/38

* cited by examiner

*Primary Examiner* — Robert Karacsony
(74) *Attorney, Agent, or Firm* — Andrew Wilford

(57) ABSTRACT

An antenna having a base film carrying at least one antenna structure and one electronic device with a contact region of the at least one antenna structure being provided on a tab formed from the base film and contacted with a contact region of the electronic device is made by first providing the electronic device inside a housing. Then the tab is inserted into the housing. Finally the housing is adhesively adhered in place on the base.

6 Claims, 3 Drawing Sheets

ANTENNA ASSEMBLY AND METHOD OF MAKING SAME

CROSS REFERENCE TO RELATED APPLICATIONS

This application claims the priority of German patent application 10 2012 002 182.8 filed 7 Feb. 2012.

FIELD OF THE INVENTION

The invention relates to an antenna as well as a method of making such an antenna according comprising a base film carrying at least one antenna structure and an electronic device, a contact region of the at least one antenna structure being constituted as a tab formed from the base film and contacted with a contact region of the electronic device.

BACKGROUND OF THE INVENTION

DE 10 2005 009 443 discloses an antenna formed as a film antenna for a vehicle. This antenna has a base film having at least one antenna structure, and an electronic device, a contact region of the at least one antenna structure being mounted on a tab formed by the base film, and contacted with a contact region of the electronic housing. The electronic device has a printed circuit board carrying electronic components in order to perform the function of the electronic device (for example, when used as an antenna amplifier). The electronic device is provided on the base film and brought into contact with the antenna structures. Afterward, this component that has been assembled in this manner is installed in a vehicle. However, this has the disadvantage that the electronic device with the delicate electronic components thereof is completely unprotected. Moreover, in a variant as described in the prior art, it is disadvantageous that the ends of the antenna structures that are located at the tab, must be connected to connectors, and the connectors are then brought into contact with complementary connectors of the electronic housing. This requires additional complexity in terms of assembly; and there exists the risk that, when mounting the apparatus of the electronic device on the base film, the user forgets to position a connector. As a result, the electronic device cannot function properly.

OBJECT OF THE INVENTION

The basic object of the invention is to provide an antenna as well as a method of making such an antenna that improved on the prior art. In particular, the invention seeks to provide better protection for the electronic device against external influences while simplifying the assembly at the same time.

SUMMARY OF THE INVENTION

Regarding the antenna, the invention envisions mounting the electronic device (before assembly on the base film) inside a housing, the tab extending into the housing and the housing is provided on the base film in such a manner that it is fixed in place. On the one hand, the housing protects the electronic device against external influences. Moreover, this also translates into a simplification in terms of assembly, because the housing that contains the printed circuit board with the electronic components is mounted on the base film easily, quickly and without complication, for example by gluing. Connecting the ends of the antenna structures provided at the tab, can be achieved either prior to the assembly of the housing on the base film or thereafter. For example, the housing can include a slot into which the tab is inserted, and, following the completed insertion of the tab into the housing, connecting with the corresponding contact regions of the printed circuit board of the electronic device.

In an improvement of the invention, the tab forms a opening in the base film that is at least of equal size as it; and this opening is covered up by the housing of the electronic device. This means that the tab is provided within the base film (as opposed to on the edge thereof), for example by punching it out, and the contact regions of the antenna structures are located on the tab. It is then possible to flexibly insert the tab into the housing of the electronic device and establish contact with it therein. The tab simultaneously provides strain relief for the contact region, so it is impossible for temperature fluctuations, mechanical movements (in particular, vibrations) and the like to have a permanent negative effect on the contact region.

In an improvement of the invention, the housing of the device comprises a top part and a bottom part, and the tab is inserted into the inside of the housing between these two parts. The advantage of this lies in the fact that it is possible to mount the bottom part on the base film first. The tab is then inserted into it and then the printed circuit board is placed on the bottom part (or vice versa). The housing is then closed by placing the top part onto the bottom part, whereby connections are formed between the contact region of the tab and the associated contact region of the printed circuit board of the electronic device. This means a simplification of assembly, so that the housing and the base film are fixed in place one after the other, while connection is effected at the same time. Subsequently, the antenna that is comprised of the base film with antenna structures and an electronic device provided thereon, is available for further use, namely for installation in the vehicle.

In an improvement of the invention, the top part has at least one pusher formation, and/or the bottom part has at least one counter-element that acts, if necessary, in conjunction with the pusher formation, the pusher formation applying a force to push together the contacts. The pusher formation that generates, in particular, a biasing spring force has the effect of advantageously applying a continuous force that presses the contact regions against each other and/or on each other in order to ensure a permanent contact. For the pusher formation, which is advantageously provided on the top part, to permanently apply a defined force, it must act advantageously in conjunction with a counter-element of the bottom part. It is understood that the reverse arrangement, namely pusher formation on the bottom part and counter-element on the top part, is possible as well.

In an improvement of the invention, an adhesive layer is provided on a face of the housing that is directed toward the base surface, particularly of the bottom part. This adhesive layer has at least one first function. In fact, the adhesive layer serves for adhering the housing to the base film, particularly the bottom part. Before assembly of the housing, the adhesive layer is protected by a strip layer in such a manner that it is necessary to remove the strip layer before the housing can be glued onto the base film. This increases assembly speed, and current adhesive layers are suitable and constituted such that the housing is permanently and immovably provided on the base film. Moreover, the adhesive layer has still another function. Due to the fact that the adhesive layer extends over the opening created by formation of the tab, it is possible to fasten the entire antenna on a vehicle component using only this part of the adhesive layer. This is because the tab is inserted into the housing, such that this results, preferably, in the opening being located below part of the total region. Using this opening, it is possible to connect the adhesive layer that is located on the bottom face of the housing with the vehicle component. Correspondingly, a further configuration of the invention provides for the adhesive layer to be covered up at least by one strip layer, if only the housing must be provided on the base film (covering up the opening, or not). Furthermore, it is also advantageous to provide a second strip layer that is removed after the first strip layer has been removed prior to the second strip layer and that is used for adhering the housing in place on the base film. In this case, it is possible to remove the second strip layer at a later time; namely when the antenna is to be mounted on the vehicle.

Regarding the method of making an antenna of this kind, the invention provides that the electronic device is provided inside a housing, the tab is inserted into the housing, and the housing is adhered in place on the base film. This results in the same advantages as described above with regard to the structural configuration of an antenna.

Furthermore, the invention envisions that an adhesive layer provided on the bottom face of the housing is covered up by at least one strip layer, preferably two strip layers, prior to the housing being fixed in place on the base film; and the at least one strip layer is removed in order to then glue the housing into a fixed position on the base film. This makes it possible to mount the housing, particularly the bottom part thereof, quickly and easily in a desired position on the base film.

An improvement of the invention provides that the second strip layer is removed in order to adhere the base film in position on the support. The second strip layer is accessible via the opening, which is formed by the tab, such that the entire antenna can be glued in place on the support following removal of the second strip layer. Therefore, after fastening the electronic device to the base film by gluing, it is possible for the total combination, which is made up of housing and base film carrying the antenna, to be glued onto the support. As an improvement of the invention, it is correspondingly envisioned that an opening is punched out of the base film and is covered up by the housing of the electronic device after the same has been adhered in place on the base film. Punching out the opening creates, on the one hand, the tab that is inserted into the electronic device for connecting; and by way of this insertion process, the opening is exposed. In the opening, the second strip layer of the glued layer is then accessible on the bottom face of the housing, such that it can be pulled off when the antenna must be permanently provided on the support by means of a gluing step. Following the removal of the second cover, the adhesive area covered up until this time, becomes accessible via the opening and can be used for gluing the antenna to the support.

BRIEF DESCRIPTION OF THE DRAWING

Below, the antenna and method of making the same according to the invention are described in further detail. The figures show as follows.

DETAILED DESCRIPTION

Figure 1:
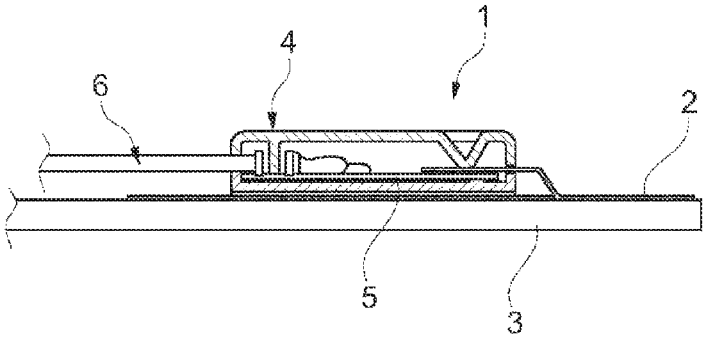
FIG. 1 is a sectional schematic view of an antenna according to the invention.

As shown in FIG. 1, an antenna 1 has a base film 2. Antenna structures are mounted for carrying-out receiving and/or transmitting functions on this base film 2. The antenna 1 is provided on a support 3, and a housing 4 with a printed circuit board 5 is permanently fixed on the base film 2. The electronic components are located as required on the printed circuit board 5 for carrying out the desired receiving and/or transmitting functions or signal-processing operations. On the output side, the printed circuit board 5 is connected to an antenna cable 6. This antenna cable 6 connects the electronic device (configured, for example, as an adjustment device, amplifier, signal processor or the like) to a further electronic device located downstream, not shown here.

Figure 2:
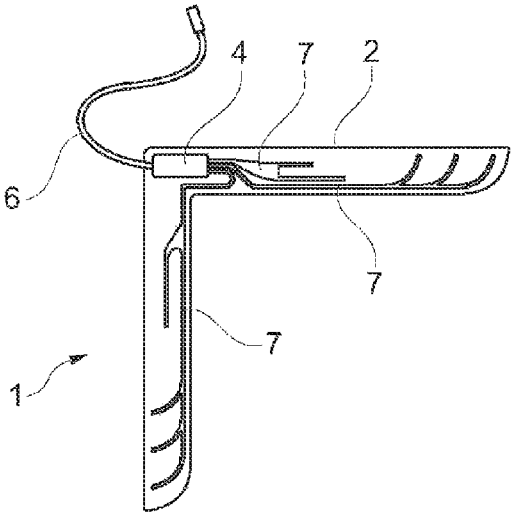
FIG. 2 is a elevational view of another antenna according to the invention.

FIG. 2 shows the antenna 1 with the base film 2, the housing 4 of the electronic device, as well as the antenna cable 6. One or more antenna structures 7 are provided as required on the base film 2. In this case, the base film 2 is divided in two sections that extend at a right angle to each other. It is understood that any other shapes of the base film 2 are also conceivable.

Figure 3:
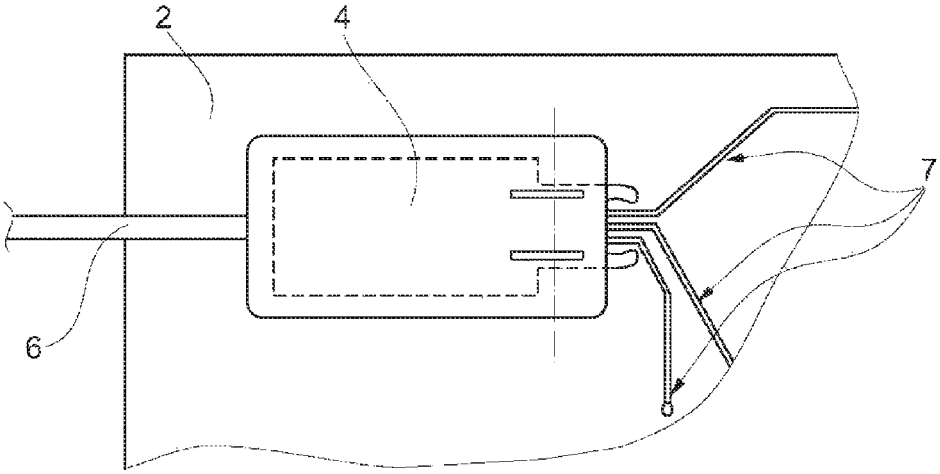
FIG. 3 is a large-scale view of a detail of FIG. 2.

FIG. 3 is a detail view showing the assembly of the housing 4 on the base film 2 with three or more antenna structures 7 extending away from the housing 4. This is important because the respective ends of the antenna structures 7 must be connected to the respective contact regions on the printed circuit board 5 within the housing 4.

Figure 4:
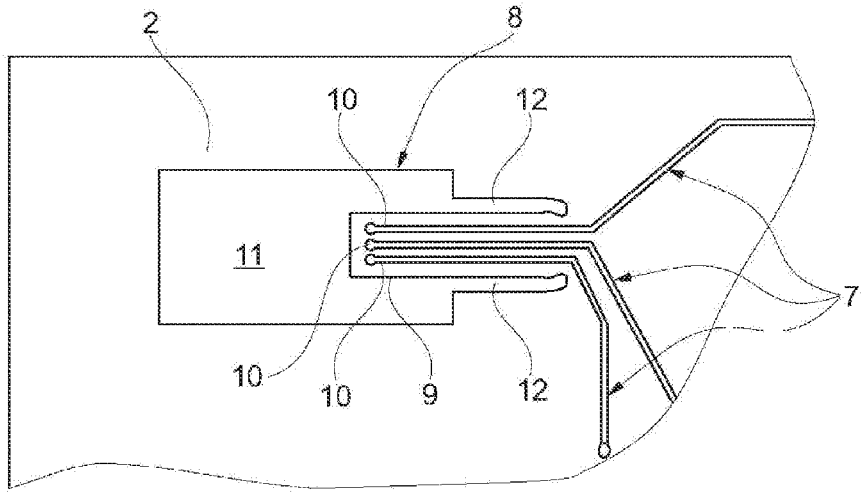
FIG. 4 is a view like FIG. 3 but with the housing not shown.

FIG. 4 shows the base film 2 before mounting of the housing 4 on it. It is important to form a punchout 8 that forms a tab 9 from the base film 2. In the simplest form thereof, the punchout 8 corresponds to the external shape of the tab 9. When the tab 9 is thus punched out such that contact regions 10 of the antenna structures 7 are located in it. This means that in the embodiment according to FIG. 4, the tab 9 is rectangular while the antenna structures 7 extend parallel relative to each other to form the contact regions 10 on the tab 9. Due to the fact that, according to FIG. 4, the outer shape of tab 9 is different from the punchout 8, an opening 11 is formed. This opening 11 is used for mounting the antenna on the support as will be described below. Furthermore, the punchout 8 has longitudinal extensions 12 that form openings extending parallel to the tab 9 from the continuous edge of the punchout 8 along the edges of the tab 9. These openings are necessary to allow for flexing of the tab for connecting purposes.

Figure 5:
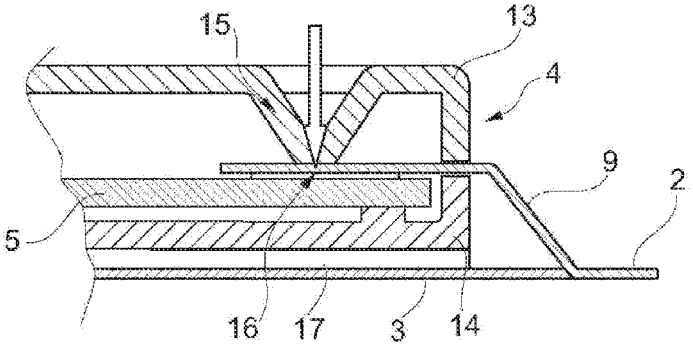
FIG. 5 is a section through the structure of FIG. 3.

After the punching process that creates the tab 9 (and, if necessary, the opening 11) is completed, the housing can be mounted on the base film 2 to connect of the antenna structures 7 with the printed circuit board 5 by means of the contact regions 10 on the tab 9. This is shown in FIG. 5 where the housing 4 is made of a top part 13 and a bottom part 14. First, the bottom part 14 is mounted on the base film 2, preferably covering up the opening 11. The bottom part 14 holds the printed circuit board 5 against which the tab 9 is subsequently pressed, together with the contact regions 10 of the antenna structures 7, over the bottom part 14. The housing part 14 is afterward closed when the top part 13 is fitted onto the bottom part 14. In this embodiment, the top part 13 comprises a pusher formation 15. The pusher formation 15 is configured such that it presses contact regions 16 and the respective contact regions 10 together. Preferably, the pusher formation 15, which is V-shaped when seen in a cross-section, is elongated like a bar at the F-tip and presses against the contact regions 10 located adjacent each other on the tab 9 and simultaneously against the respective contact regions 16 of the printed circuit board 5. In this case, the printed circuit board 5 is the counter-element for the pusher formation 15.

According to the previously described assembly order, one embodiment of the antenna has been completed for installation on the support. In fact, the housing 4 constituted of the top part 13 and bottom part 14 is mounted on the base film 2, and the antenna structures 7 are in permanent contact with the electronic device inside the housing 4. By configuring the tab 9 as showed in FIG. 4, effective tension relief of the mated contact regions 10, 16 is achieved.

Figure 6:
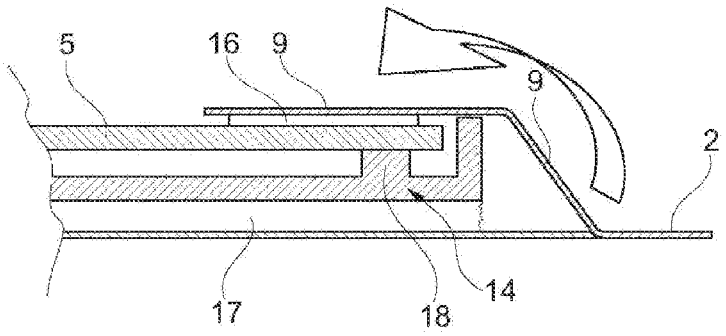
FIG. 6 is a view like FIG. 5 but with the top part of the housing not shown.

To further improve ease of assembly, reference is being made to FIG. 6 showing that the bottom housing part 14 has an adhesive layer 17 that adheres the top part 14 to the surface of base film 2. Moreover, the bottom part 14 comprises a counter-element 18 that is suitable for use as a brace for the printed circuit board 5 inside the housing 4 and/or as counter-element for the pusher formation 15. Due to the fact that the printed circuit board 5 is typically a rigid, two-dimensional element, the counter-element 18 does not have be directly aligned with the pusher formation 15; instead, it can be offset somewhat therefrom. After the bottom part 14 has been secured by the adhesive layer 17 to the surface of the base film 2, the printed circuit board 5 is inserted into the bottom part 14. Subsequently, the tab 9, which until then had been located in the same plane as the base film 2, is lifted from this plane, specifically in such a manner that the at least one contact region 10 of the tab 9 is aligned with at least one respective contact region 16 of the printed circuit board 5. If it has been the tab 9 has been positioned as shown in FIG. 6, or if the it has been secured by additional steps in this position (for example, caulking, clipping, gluing or the like), it is possible to place the top part 13 onto the bottom part 14. To this end, the top part 13 is, for example, glued, latched, screwed, or the like to the bottom part 14. These two parts 13, 14 are configured such their mating peripheries fit almost hermetically together. It is possible to envision, if necessary, depending on the thickness of the base film 2, a cutout in the top part 13 and/or the bottom part 14 at the tab 9 insertion of the tab 9. Moreover, it is possible to provide a seal between the two peripheries of the two parts 13, 14. The end of the pusher formation 15 therein is provided so as to press together the two contact regions 10, 16 that are directed toward each other, permanently applying a force against these contact regions.

Figure 7:
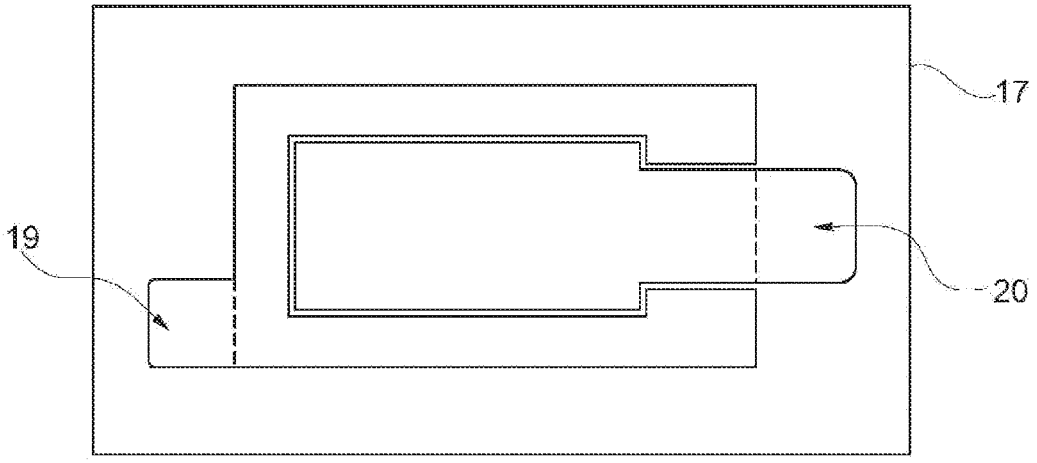
FIGS. 7 and 8 are views of other embodiments of the invention.
Figure 8:
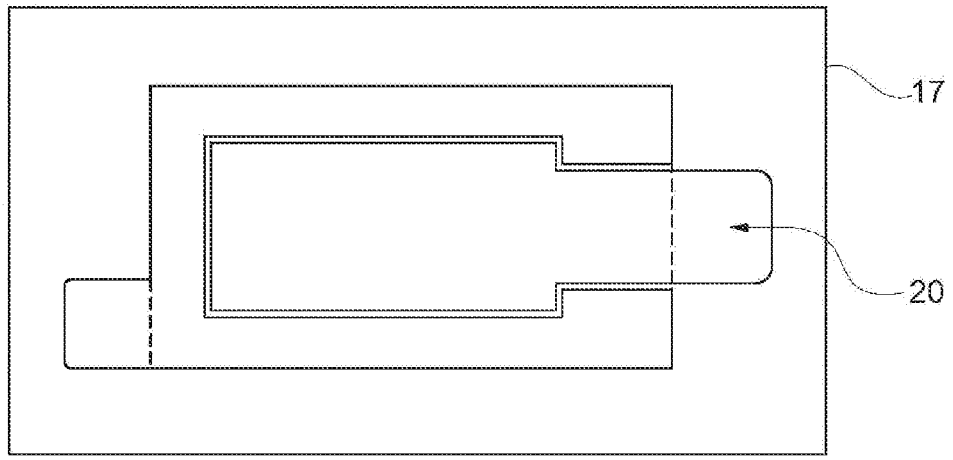

A further variant of the antenna 1 is described in FIGS. 7 and 8. Regarding configurations, as shown in FIGS. 1 and 5, the antenna was, in principle, already completed by the fact that the housing 4 was adhesively fixed in place on the base film 2, and in that the antenna 1 can be fixed on the support of a motor vehicle.

The second further variant of the antenna 1 is characterized in that the adhesive layer 17 extends across the entire bottom face of the housing 4 or the bottom part 14. Regarding the first variant, this adhesive layer 17 is completely covered by a first, meaning a single strip layer 19. After removing the single strip layer 19, it is possible to glue the bottom part 14 in place on the base film 2. Regarding the further variant, however, the adhesive layer 17 has the first strip layer 19 as well as a second strip layer 20. Advantageously, the shape of the first strip layer 19 conforms exactly to the outer periphery of the punchout 8 (see FIG. 4). This means, by pulling off the first strip layer 19, that region of the adhesive layer 17 is exposed that corresponds to the region surrounding the punchout 8. This way, it is possible to glue the bottom part 14 onto the base film 2, while the second strip layer in the opening 16 first covers up the adhesive layer 17 that is also present at that location. After the housing 4, more specifically the bottom part 14 thereof, has been glued by the adhesive layer 17 to the surface of the base film 2 after the removal of the first strip layer 19, the antenna 1, which has thus been prepared, can, following contacting and closing of the housing 4, be used in the further assembly step. This further assembly step consists in removing the second strip layer 20 to expose the adhesive layer 17 in the opening 11 so that it is possible for this exposed adhesive layer 17 (corresponding to a part of the total area of the adhesive layer) to adhere the antenna to the support. While it can be sufficient to glue the antenna 1 only in this partial area of the total adhesive layer 17 to the support, by way of a supplementary consideration, it can be conceivable to provide the bottom face of the base film 2 also with an adhesive layer, such that the total antenna 1 is fixed in place on the support by the partial adhesive layer in the opening 11 as well as by the adhesive layer of the base film 2.

The invention claimed is:

1. A method of making an antenna having
a base film formed with a tab,
at least one antenna structure carried on the base film,
an electronic device also carried on the base film and having a contact region,
another contact region on the tab formed from the base film and engaging the contact region of the electronic device, the method comprising the steps of:
forming the base film with the tab,
punching an opening out of the base film,
providing the electronic device inside a housing,
inserting the tab into the housing, and
adhesively fixing the housing in place on the base film and thereby covering up the punched-out opening with the housing.

2. The method defined in claim 1, further comprising the step of:
providing an adhesive layer on the bottom face of the housing,
covering at least part of the adhesive layer on the bottom face of the housing by a first strip layer prior to the housing being adhesively fixed in place on the base film, and
removing the first strip layer in order to then adhere the housing in place on the base film.

3. The method defined in claim 2, further comprising the steps of:
covering another part of the adhesive layer with a second strip layer; and
removing the second strip layer in order to adhere the base film in place on a support.

4. The method defined in claim 1, wherein the opening has a shape corresponding to that of the second strip layer, and the first strip layer annularly surrounds the second strip layer.

5. The method defined in claim 1, wherein the housing is formed of a lower part that is adhesively fixed on the base film and an upper part secured to the lower part, enclosing the electronic device and tab therewith, the tab extending into the housing between the upper part and the lower part.

6. The method defined in claim 5, wherein the upper part is provided with a pusher formation that presses the tab down against the contact region of the electronic device.

* * * * *